United States Patent [19]

De Vittori

[11] 4,161,723

[45] Jul. 17, 1979

[54] FLAGPOLE PARTICULARLY FOR INDICATING GOALS IN SKIING COMPETITIONS

[76] Inventor: Gianfranco De Vittori, via al Fiume 1a, Viganello, Switzerland

[21] Appl. No.: 894,343

[22] Filed: Apr. 7, 1978

[30] Foreign Application Priority Data

Apr. 28, 1977 [CH] Switzerland ..... 5418/77
Jun. 22, 1977 [CH] Switzerland ..... 7684/77

[51] Int. Cl.[2] ..... E04H 12/32

[52] U.S. Cl. ..... 340/323 R; 362/431; 340/114 R; 116/173; 116/306

[58] Field of Search ..... 116/173, 124 R; 52/103, 52/155; 403/221, 222, 220, 229; 404/10; 362/431; 340/323 R, 114 R

[56] References Cited

U.S. PATENT DOCUMENTS

| | | | |
|---|---|---|---|
| 212,238 | 2/1879 | Lewis | 52/155 |
| 1,041,173 | 10/1912 | Ryans | 116/173 |
| 3,067,717 | 12/1962 | Imparato | 116/173 |
| 3,279,133 | 10/1966 | De Korte | 403/229 |
| 3,286,682 | 11/1966 | Cook | 116/173 |

OTHER PUBLICATIONS

Popular Mechanics; vol. 100; No. 6; p. 196; Dec. 1953.

*Primary Examiner*—S. Clement Swisher
*Assistant Examiner*—Denis E. Corr

[57] ABSTRACT

A flagpole, particularly for indicating goals in skiing competitions, comprising an upper flag carrying portion and a lower pointed portion connected by a helical spring. When this flagpole is driven into the ground, it can move elastically laterally when hit by a skier, thus avoiding to be knocked down or causing injuries to the skier. Preferably the flagpole is provided with a semi-cylindrical abutment shell on one side so that it can move only to the other side, with a telescoping sleeve in its lower pointed portion for adjusting its length, and anvils adapted to be struck with a hammer for driving it down into the ground or hard snow.

4 Claims, 6 Drawing Figures

FLAGPOLE PARTICULARLY FOR INDICATING GOALS IN SKIING COMPETITIONS

This invention relates to a flagpole particularly but not exclusively for indicating goals in skiing competitions such as a gate in a slalom race or the like, but also for other sports such as golf.

For indicating the limits of the gates in a ski competition such as a slalom race or the like it is common to use a rigid pole carrying a flag at one end and having a point or spike at the other, adapted to be driven into the ground. These poles are often hit and knocked down by the skier if he does not manage to pass the gate correctly. Then an assistant must reposition the pole and quite a number of such assistants are required along the course to avoid interruptions of the race. Further, it is often difficult or impossible to place the pole into the exact previous position as it would be necessary to maintain the characteristics of the course constant for all skiers who participate in the race.

It may also happen that a skier is injured when he hits a rigid pole in a particularly unfortunate manner.

It is an object of the present invention to eliminate these drawbacks by providing a flagpole of the type described above, which does not have to be continuously repositioned by the assistants along the course to reestablish the gate limits and nevertheless permits to ascertain whether the gate pole has been hit and thus the gate limits have been violated by a skier.

It is another object of the invention to provide a flagpole of this type that affords greater security in avoiding injuries to skiers hitting the flagpole.

This is achieved according to the invention by providing a helical spring between the upper flag carrying portion and the lower pointed portion of the flagpole, said helical spring being rigidly connected with its ends to said upper and lower portions of the flagpole.

Also the thickness of the snow covering the ground may vary widely so that the lower portion of the flagpole may project from the snow when it is not deep and when it is deep, a considerable portion of the length of the flagpole may be buried in the snow so that the point of the flagpole cannot be securely anchored in the ground or hard snow.

To overcome this drawback, the lower portion of the flagpole may be formed of two members, an upper tubular member and a lower pointed stem member mounted for sliding movement within the upper tubular member and provided with means for locking it in different vertical positions with respect to the tubular member. In this manner the height of the flagpole may be adjusted to various heights of snow.

It has also been found that the flagpole is not very well visible in foggy or misty weather. To avoid this, the flagpole according to the invention may be provided at its upper end with a battery-powered lamp.

Two preferred embodiments of the invention will now be described by way of example and with reference to the accompanying drawings, in which.

Figure 1:
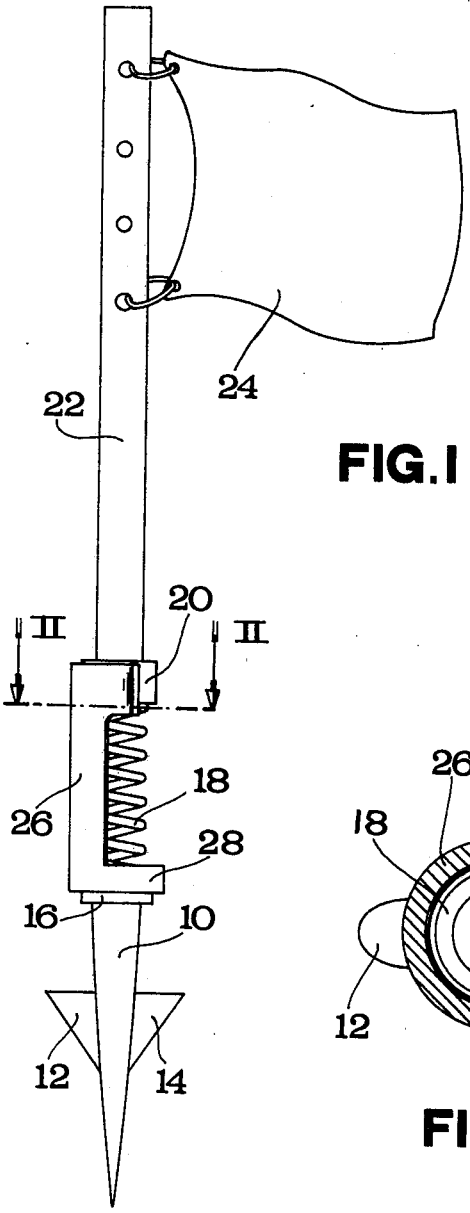
FIG. 1 is a side view of a flagpole according to the first embodiment of the invention.
Figure 2:
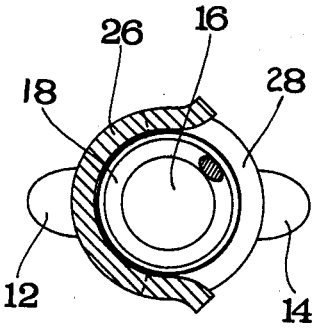
FIG. 2 is a transverse section of the flagpole on an enlarged scale, taken along the line II—II of FIG. 1.
Figure 3:
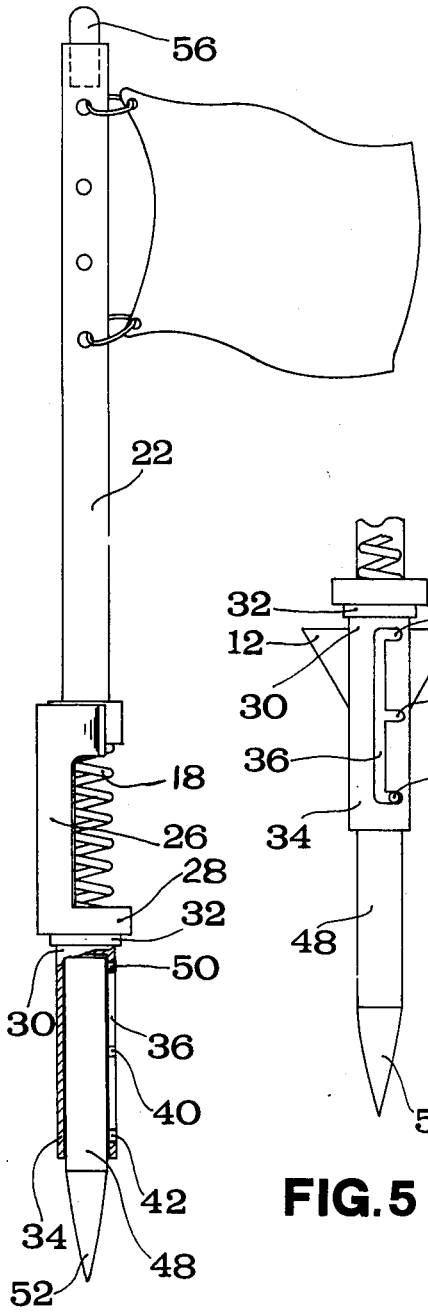
FIG. 3 is a side view of the flagpole according to the second embodiment of the invention, with the lower portion in axial section taken along the line III—III of FIG. 4.
Figure 5:
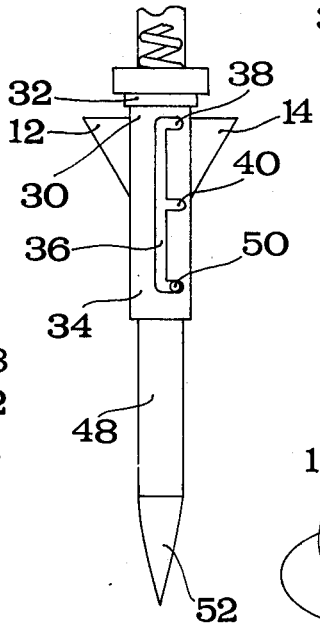
FIG. 5 is a side view of the lower portion of the flagpole of FIG. 3 in the extended position.
Figure 4:
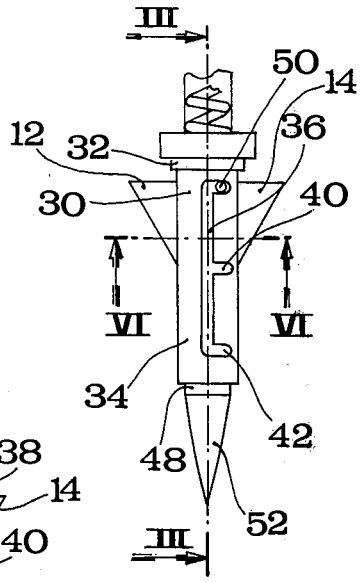
FIG. 4 is a side view of the lower portion of the flagpole of FIG. 3 in the retracted position.
Figure 6:
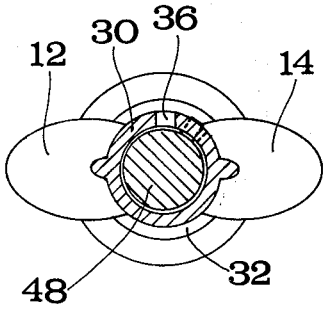
FIG. 6 is a transverse section taken along the line VI—VI of FIG. 4.

Referring first to FIGS. 1 and 2, the flagpole according to the first embodiment of the invention comprises a spike or pointed end 10 to be driven into the ground. For this purpose the pointed end 10 is provided with a pair of lateral anvils 12 and 14 which can be struck with a club or hammer (not shown) to forcedly drive the flagpole into the ground if it cannot be forced into the ground by hand. The spike 10 terminates upwardly with a sleeve 16 from which a helical spring 18 extends coaxially to the flagpole. The other end of the helical spring 18 is secured to a similar sleeve 20 from which extends upwardly a rigid pole 22 carrying a flag 24 at its upper end. In the rest position of the spring 18, the rigid pole 22 extends vertically upwardly from the sleeve 20 coaxially to the spike 10, but the spring 18 permits it to bend laterally when it is hit by a skier.

Preferably the pole 22 is allowed to bend only to one side by providing an abutment 26 in the form of a substantially semicylindrical shell embracing about one half of the periphery of the spring 18 and extending over its entire length. The shell 26 is rigidly secured to the sleeve 16, but preferably so that it can be turned thereon around the axis of the pole. Preferably a bushing 28 formed integrally with the lower end of the shell 26 and embracing the sleeve 16 with a snug frictional fit may be used for this purpose.

For use as a flagpole in skiing competitions the spike 10 of the flagpole is driven into the ground, if necessary, by hammering it down with a club or hammer on the anvils 12 and 14, and then the bushing 28 is turned so as to place the shell 26 toward the inside of the gate to be marked by the flagpole. When the flagpole is then hit by a skier passing through the gate, but touching one of the limits thereof marked by such flagpoles, the flagpole that has been hit will first bend outwardly and then oscillate, giving a clearly visible indication of the skier's error. The flagpole may bend outwardly as toward the outside of the gate there is no abutment for preventing the flagpole from bending. Due to the elasticity of the spring 18, the flagpole is prevented from being overthrown or at least cannot be pulled out easily. The spring 18 will ultimately restore the flagpole to a vertical position. The shell 26 prevents the flagpole from swinging toward the inside of the gate, thus avoiding any risk of the skier being struck by the swinging flagpole. As the shell 26 can be turned around the axis of the flagpole, the direction of swinging of the latter can be adjusted without changing the position of the spike 10 driven into the ground.

In the second embodiment shown in FIGS. 3 to 6, the length of the flagpole can be adjusted. For this purpose the spike 52 of the flagpole 22 shown in FIG. 3 has a stem 48 mounted for sliding movement within a tubular member 34 having at its upper end 30 a sleeve 32 corresponding to the sleeve 16 of the FIG. 1 embodiment. The tubular member 34 is provided with a longitudinal vertical slot 36 having transverse horizontal branches 38, 40 and 42, as shown more clearly in FIGS. 4 and 5, with the horizontal branches 38 and 42 located at the ends of the vertical slot 36 and the horizontal branch 40 intermediate the ends thereof. A pin 50 extends perpendicularly from the periphery of the pointed stem 48 into the vertical slot 36 and is longitudinally slidable therein as the stem 48 is extracted from or pushed into the tubular member 34. The pin 50 can be inserted and locked in one of the transverse slots 38, 40, 42 by slightly turning the stem 48 relative to the tubular member 34 adjacent one of those slots to thereby vary and fix the length of the flagpole.

Mounted at the upper end of the flagpole 22 is a battery-powered lamp 56 covered by a transparent casing and provided with a switch (not shown) which, if desired, may be such as to provide intermittently flashing operation of the lamp.

The other components such as helical spring 18, abutment shell 26, bushing 28 and anvils 12 and 14 are the same as in the first embodiment shown in FIGS. 1 and 2.

The flagpole according to the second embodiment shown in FIGS. 3 to 6 is used in the following manner:

After having examined the depth of the snow at the edge of the course, the stem 48 is moved telescopically along the tubular member 34 to adjust the lower portion of the flagpole to the required length, after which it is locked by angularly rotating the stem 48 into one of the horizontal slots 38, 40 or 42. In this manner the flagpole can be used in the best possible way so that the sleeve 32 will just emerge from the snow after the flagpole has been driven in.

In the case of fog or mist the lamp 56 may be switched on.

Although two preferred embodiments of the invention have been described herein in detail it is to be understood that the invention is not limited to these precise embodiments and that numerous changes and modifications obvious to one skilled in the art may be made therein without departing from the scope of the invention as defined by the appended claims.

I claim:

1. A flagpole, for indicating goals in skiing competitions, comprising an upper flag carrying portion and a lower pointed portion for insertion in the ground, a helical spring rigidly secured at its ends to said upper and lower portions of said flagpole in coaxial relationship therewith, a semicylindrical shell embracing substantially half of the periphery of the helical spring and extending over its entire length arranged on one side of said helical spring to form an abuttment for said upper portion, a bushing integral with said shell embracing said lower pointed portion, said bushing having a snug frictional fit permitting said abutment to be angularly rotated relative to said lower pointed portion.

2. A flagpole as claimed in claim 1, wherein said lower pointed portion of said flagpole is formed of two members, an upper tubular member and a lower pointed stem member mounted for sliding movement within the upper tubular member and provided with means for locking it in different vertical positions with respect to said tubular member.

3. A flagpole as claimed in claim 2, wherein said locking means comprises a vertical longitudinal slot located in said upper tubular member and having at least two transverse horizontal branches, and a pin extending perpendicularly from the periphery of said pointed stem member and rigidly mounted thereon for longitudinal sliding movement in and along said vertical longitudinal slot.

4. A flagpole as claimed in claim 3, wherein a battery-powered lamp with associated switch is mounted at the upper end of said flagpole.

* * * * *